US005746379A

United States Patent [19]

Shimizu

[11] Patent Number: 5,746,379

[45] Date of Patent: May 5, 1998

[54] METHOD OF PRODUCING CORELESS TOILET PAPER ROLL AND CORELESS TOILET PAPER ROLL PRODUCED THEREBY

[76] Inventor: Akira Shimizu, 1600-3 Fujioka, Fuji, Shizuoka, 417, Japan

[21] Appl. No.: 759,637

[22] Filed: Dec. 5, 1996

[30] Foreign Application Priority Data

Nov. 12, 1996 [JP] Japan ..... 8-300203

[51] Int. Cl.[6] ..... B65H 18/20; B65H 18/28; B65H 19/28

[52] U.S. Cl. ..... 242/160.1; 242/532.2; 242/532.3; 242/533.7; 242/583; 242/542

[58] Field of Search ..... 242/160.1, 160.4, 242/527, 532.2, 532.3, 533.7, 535.1, 541.2, 542, 542.1, 542.2, 583, 908, DIG. 3

[56] References Cited

U.S. PATENT DOCUMENTS

| | | | |
|---|---|---|---|
| 1,868,115 | 7/1932 | Mulligan | 242/532.3 |
| 1,930,250 | 10/1933 | Mulligan | 242/583 |
| 2,541,476 | 2/1951 | Mihalyi | 242/583 |
| 2,571,796 | 10/1951 | Ulmschneider et al. | 242/583 |
| 2,585,227 | 2/1952 | Christman | 242/532.2 |
| 2,951,656 | 9/1960 | Wellman | 242/583 |
| 3,910,517 | 10/1975 | Harrison | 242/532.2 |
| 4,304,368 | 12/1981 | Bartmann | 242/532.2 |
| 5,467,936 | 11/1995 | Moody | 242/532.3 |
| 5,518,200 | 5/1996 | Kaji et al. | 242/541.2 |

*Primary Examiner*—John M. Jillions
*Attorney, Agent, or Firm*—Kanesaka & Takeuchi

[57] ABSTRACT

In producing a coreless toilet paper roll, a shaft is placed near an end portion of paper, and an adhesive is applied to either one of two sides of the paper relative to the shaft without providing to the shaft. The end of the paper is turned onto the other side over the shaft and is glued to the other side so that the end portion of the paper is fixed to the shaft. Thereafter, the shaft and the paper fixed at one end to the shaft are held among two take-up rollers and a pressure roller, and are rotated to wind the paper on the shaft. After winding the paper on the shaft, the shaft is removed from the roll and the paper is cut. The cutting of the paper and gluing the paper for the next rolling may be made at the same time.

5 Claims, 11 Drawing Sheets

METHOD OF PRODUCING CORELESS TOILET PAPER ROLL AND CORELESS TOILET PAPER ROLL PRODUCED THEREBY

BACKGROUND OF THE INVENTION

1. Field of the Invention

The present invention generally relates to a method of producing a coreless toilet paper roll and to the coreless toilet paper roll produced thereby. More particularly, the present invention relates to a method of producing a coreless toilet paper roll, wherein parts of paper, which are located close to an initial end portion thereof, are glued together to thereby prevent the coreless toilet paper roll from fraying, and to the coreless toilet paper roll produced thereby.

2. Description of the Related Art

In the case of a conventional toilet paper roll having a paper tube in the central part thereof, the cost thereof is increased by that of the paper tube. Moreover, the toilet paper roll is troublesome in that after all of the toilet paper roll is used up, the center paper tube cannot be flushed away from the toilet and should be thrown away in another place. For such reasons, coreless toilet paper rolls are now becoming widespread (see, for example, the Japanese Utility Model Publication No. 6-47357).

In the case of a toilet paper roll 100 described in Japanese Utility Model Publication No. 6-47357, as illustrated in FIG. 18, an adhesive 101 is sprayed onto a part that is at a distance X (ranging from about 30 to 70 cm) from an initial end portion 100A of the toilet paper roll 100. Then, a part 102 of paper is wound through the adhesive 101.

The reason for spraying the adhesive 101 onto the part located at a distance X (ranging from about 30 to 70 cm) from the initial end portion 100A of the toilet paper roll 100 in this way is as follows.

Namely, if the adhesive 101 is sprayed toward the initial end portion 100A of the toilet paper roll 100 by a spray nozzle 103 when spraying the adhesive 101 onto the part 102 of paper, the adhesive 101 sticks to a shaft 104 because of the fact that the spray nozzle 103 for spraying the adhesive 101 is provided in such a manner as to face the shaft 104. Thus, when the part 102 of paper is wound around the shaft 104, there is caused a trouble in that the part 102 of paper sticks to the shaft 104.

Further, when the part 102 of paper is wound around the shaft 104, a first take-up roller 105 and a second take-up roller 106 are rotated clockwise. Moreover, the shaft 104 is rotated counterclockwise. Thereby, the part 102 of paper is wound around the shaft 104. Thereafter, the shaft 104 is detached from the wound part 102 of paper. Thus, the coreless toilet paper roll 100 is produced. In FIG. 19, reference numeral 107 designates a nip roller (namely, a pressure roller) adapted to abut against and firmly wind the part 102 of paper; and 108 in FIG. 20 is a hole representing a coreless portion.

However, in the case of the aforementioned toilet paper roll 100, the adhesive 101 is applied onto a part thereof, which is located at a distance of about 30 to 70 cm from the initial end portion 100A thereof. Thus, the aforementioned toilet paper roll 100 is liable to fray or ravel from the initial end portion 100A thereof. When fraying, the appearance of the toilet paper roll 100 is unattractive or deteriorated.

Further, the aforementioned toilet paper roll 100 has a problem in that if the initial end portion thereof ravels and further comes to fray badly when the toilet paper roll 100 is in use, namely, if it is fitted into a toilet paper holder, the toilet paper roll 100 does not rotate and thus is not so easy to use.

It is, accordingly, an object of the present invention to provide a method of producing a coreless toilet paper roll, by which the aforesaid drawback is eliminated, and to provide a coreless toilet paper roll produced thereby.

SUMMARY OF THE INVENTION

To achieve the foregoing object, in accordance with an aspect of the present invention, there is provided a method (hereunder sometimes referred to as a first method) of producing a coreless toilet paper roll, which comprises the steps of: placing a first take-up roller and a second take-up roller in sequence along a paper supplying direction in which paper is supplied from paper supplying means, the first take-up roller and the second take-up roller being provided in such a way as to be spaced apart from each other and as to face each other; placing a pressure roller, an adhesive supplying member and a cutting portion in sequence above the first take-up roller and the second take-up roller along the paper supplying direction, the pressure roller being operative to abut against paper wound around a shaft to thereby wind the paper around the shaft firmly, the adhesive supplying member having an adhesive supplying portion provided so that the adhesive supplying portion does not face the shaft and that the adhesive supplying portion is able to move in such a manner as to approach and recede from paper which is being conveyed thereto, the cutting portion being provided so that the cutting portion is able to move in such a manner as to approach and recede from paper which is being conveyed thereto and so that when a predetermined amount of paper is wound around the shaft, the cutting portion approaches the paper conveyed thereto and cuts the paper; placing paper, which is supplied from the paper supplying means, on the first take-up roller and the second take-up roller, and positioning the shaft on the supplied paper; bringing the adhesive supplying portion close to a part of paper, which is located near an end portion thereof on a side of the second take-up roller, without causing the adhesive supplying portion and the shaft to face each other, and applying an adhesive onto the paper in a direction of width thereof from the adhesive supplying portion; supplying air from a side of a back surface of a part, to which the adhesive is applied, of the paper, and folding back the paper in such a way as to be laid over the shaft, thereby bringing the part, to which the adhesive is applied, of the paper into abutting engagement with a part, to which no adhesive is applied, of the paper and thereby gluing the parts of the paper together; thereafter rotating the first take-up roller and the second take-up roller clockwise and rotating the shaft counterclockwise, and winding the paper around the shaft and bringing the pressure roller into abutting engagement with the paper wound therearound, thereby firmly winding the paper around the shaft; and thereafter detaching the shaft from the wound paper, thereby producing a toilet paper roll.

Thus, in the case of the first method of producing a coreless toilet paper roll, when applying the adhesive to the paper, the adhesive is prevented from being stuck to the shaft. Thereby, the adhesive can be applied to a part of the paper, which is nearer to the initial end thereof (for example, is located at a distance of about 1 to 4 cm from the end portion of the paper). Consequently, a coreless toilet paper roll, by which a fray is prevented from occurring in an initial end portion thereof, is obtained.

Further, in accordance with another aspect of the present invention, there is provided a method (hereunder sometimes referred to as a second method) of producing a coreless toilet paper roll, which comprises the steps of: placing a first take-up roller and a second take-up roller in sequence along a paper supplying direction in which paper is supplied from paper supplying means, the first take-up roller and the second take-up roller being provided in such a way as to be spaced apart from each other and as to face each other; placing a pressure roller, an adhesive supplying member and a cutting portion in sequence above the first take-up roller and the second take-up roller along the paper supplying direction, the pressure roller being operative to abut against paper wound around a shaft to thereby wind the paper around the shaft firmly, the adhesive supplying member having an adhesive supplying portion provided so that the adhesive supplying portion does not face the shaft and that the adhesive supplying portion is able to move in such a manner as to approach and recede from paper which is being conveyed thereto, the cutting portion being provided so that the cutting portion is able to move in such a manner as to approach and recede from paper which is being conveyed thereto and so that when a predetermined amount of paper is wound around the shaft, the cutting portion approaches the paper conveyed thereto and cuts the paper; placing paper, which is supplied from the paper supplying means, on the first take-up roller and the second take-up roller, and positioning the shaft on the supplied paper; bringing the adhesive supplying portion close to a part of paper, which is located near an end portion thereof on a side of the second take-up roller, without causing the adhesive supplying portion and the shaft to face each other, and applying an adhesive onto the paper in a direction of width thereof from the adhesive supplying portion; rotating the first take-up roller and the second take-up roller counterclockwise and bringing the end portion of the paper close to the shaft; thereafter supplying air from a side of a back surface of a part, to which the adhesive is applied, of the paper, and folding back the paper in such a way as to be laid over the shaft, thereby bringing the part, to which the adhesive is applied, of the paper into abutting engagement with a part, to which no adhesive is applied, of the paper and thereby gluing the parts of the paper together; thereafter rotating the first take-up roller and the second take-up roller clockwise and rotating the shaft counterclockwise, and winding the paper around the shaft and bringing the pressure roller into abutting engagement with the paper wound therearound, thereby firmly winding the paper around the shaft; and thereafter detaching the shaft from the wound paper, thereby producing a toilet paper roll.

Thus, in the case of the second method of producing a coreless toilet paper roll, the paper can be wound around the shaft by reducing the looseness caused in the initial end portion of the paper with respect to the shaft. Further, an occurrence of a fray can be prevented by locating the initial end portion of a coreless toilet paper roll at a further inner position.

Moreover, in accordance with still another aspect of the present invention, there is provided a method (hereunder sometimes referred to as a third method) of producing a coreless toilet paper roll, which comprises the steps of: placing a first take-up roller and a second take-up roller in sequence along a paper supplying direction in which paper is supplied from paper supplying means, the first take-up roller and the second take-up roller being provided in such a way as to be spaced apart from each other and as to face each other; placing a pressure roller, an adhesive supplying member and a cutting portion in sequence above the first take-up roller and the second take-up roller along the paper supplying direction, the pressure roller being operative to abut against paper wound around a shaft to thereby wind the paper around the shaft firmly, the adhesive supplying member having an adhesive supplying portion provided so that the adhesive supplying portion does not face the shaft and that the adhesive supplying portion is able to move in such a manner as to approach and recede from paper which is being conveyed thereto, the cutting portion being provided so that the cutting portion is able to move in such a manner as to approach and recede from paper which is being conveyed thereto and so that when a predetermined amount of paper is wound around the shaft, the cutting portion approaches the paper conveyed thereto and cuts the paper; placing paper, which is supplied from the paper supplying means, on the first take-up roller and the second take-up roller, and positioning the shaft on the supplied paper; bringing the adhesive supplying portion close to a part of paper, which is located opposite to an end portion thereof relative to the shaft, without causing the adhesive supplying portion and the shaft to face each other, and applying an adhesive onto the paper in a direction of width thereof from the adhesive supplying portion, and supplying air from a side of a back surface of a part, to which the adhesive is applied, of the paper, and folding back the paper in such a way as to be laid over the shaft, thereby bringing the part, to which the adhesive is applied, of the paper into abutting engagement with a part, to which no adhesive is applied, of the paper and thereby gluing the parts of the paper together; thereafter rotating the first take-up roller and the second take-up roller clockwise and rotating the shaft counterclockwise, and winding the paper around the shaft and bringing the pressure roller into abutting engagement with the paper wound therearound, thereby firmly winding the paper around the shaft; and thereafter detaching the shaft from the wound paper, thereby producing a toilet paper roll.

Thus, in the case of the third method of producing a coreless toilet paper roll, when applying the adhesive, the adhesive is prevented from being stuck to the shaft. Thereby, the adhesive can be applied to a part of the paper, which is nearer to the initial end thereof (for example, is located at a distance of about 1 to 4 cm from the end portion of the paper). Consequently, there can be obtained a coreless toilet paper roll, by which a fray is prevented from occurring in an initial end portion thereof.

Furthermore, in the case of an embodiment (hereunder sometimes referred to as a fourth method) of the first or second method of producing a coreless toilet paper roll according to the present invention, an operation of applying the adhesive onto the part of the paper, which is located near the end portion of the paper on the side of the second take-up roller and which is used to wind up a current coreless toilet paper roll, in the direction of width thereof is performed simultaneously with an operation of cutting the paper by means of the cutting portion to be performed upon completion of an operation of winding up a coreless toilet paper roll which is precedent to the current coreless toilet paper roll.

Thus, in the case of the fourth method of producing a coreless toilet paper roll, the manufacturing speed can be increased by simultaneously performing both of the cutting operation and the applying operation of applying the adhesive.

Additionally, in accordance with yet another aspect of the present invention, there is provided a coreless toilet paper roll, which comprises: a paper roll body, in a central portion of which a hole is formed; and a roll-like portion provided at an initial end of the paper roll body. In this coreless toilet paper roll, the roll-like portion is formed like a roll by folding back an initial end portion of paper in such a manner as to be laid over a shaft, around which the paper is wound, and by gluing an initial end part and an inner part, which is located at a distance of about 1 to 4 cm from the initial end part, of the initial end portion of the paper together, with an adhesive. Further, in this careless toilet paper roll, the paper roll body is formed by winding up a remaining portion of the paper around the shaft, and the hole is formed by detaching the shaft from the paper roll body.

In accordance with this careless toilet paper roll, a fray is prevented from occurring in a surface portion of the hole of the roll. Further, the problems of the conventional careless toilet paper roll, for example, the deterioration in the appearance, which is caused by the fray, and the inconvenience for a user, which is caused by paper twined around the shaft of a toilet paper holder, can be resolved.

Other features, objects and advantages of the present invention will become apparent from the following description of preferred embodiments with reference to the drawings in which like reference characters designate like or corresponding parts throughout several views.

BRIEF DESCRIPTION OF THE DRAWINGS

FIG. 1 is a schematic process diagram illustrating a state of a toilet-paper-roll manufacturing apparatus, in which a predetermined amount of paper is wound around a shaft and the paper is cut;

FIG. 2 is a schematic process diagram illustrating a state of the apparatus just before a cutting portion ascends or descends upon completion of an operation of cutting the paper;

FIG. 3 is a schematically enlarged sectional diagram illustrating an enlarged view of a part of the paper of FIG. 2;

FIG. 4 is a schematically enlarged sectional diagram illustrating a state of the apparatus, in which the paper is positioned on a first take-up roller and a second take-up roller which are illustrated in a part of FIG. 2;

FIG. 5 is a schematically enlarged sectional diagram illustrating a state of the apparatus, in which the paper is folded back toward the shaft;

FIG. 6 is a schematic process diagram illustrating a state of the apparatus, in which the winding of the paper around the shaft is started from the state of FIG. 5;

FIG. 7 is a schematic process diagram illustrating a state of the apparatus which is halfway through an operation of winding the paper around the shaft;

FIG. 8 is a schematic process diagram illustrating a state of the apparatus which is halfway through an operation of winding the paper around the shaft and causes the pressure roller to ascend;

FIG. 9 is a schematic side view of a coreless toilet paper roll produced through the process illustrated in FIGS. 1 to 8;

FIG. 10 is a schematically enlarged sectional diagram illustrating a state of the apparatus, in which the adhesive is applied to the paper positioned on the first take-up roller and the second take-up roller;

FIG. 11 is a schematically enlarged sectional diagram illustrating a state of the apparatus, in which the paper is folded back toward the shaft after an adhesive supplying member ascends;

FIG. 12 is a schematically enlarged sectional diagram illustrating a state of the apparatus, in which the adhesive is applied to the paper positioned on the first take-up roller and the second take-up roller;

FIG. 13 is a schematically enlarged sectional diagram illustrating a state of the apparatus, in which the end portion of the paper is brought close to the shaft by rotating the first and second take-up rollers counterclockwise;

FIG. 14 is a schematically enlarged sectional diagram illustrating a state of the apparatus, in which the paper is folded back toward the shaft from the position of the paper of FIG. 13;

FIG. 15 is a schematically enlarged sectional diagram illustrating a state of the apparatus before the adhesive is applied to the paper positioned on the first take-up roller and the second take-up roller;

FIG. 16 is a schematically enlarged sectional diagram illustrating a state of the apparatus, in which the adhesive is applied to the paper positioned on the first take-up roller and the second take-up roller;

FIG. 17 is a schematically enlarged sectional diagram illustrating a state of the apparatus, in which the paper is folded back toward the shaft from the position of the paper of FIG. 16;

FIG. 18 is a schematic view of the end portion of the paper of a conventional coreless toilet paper roll;

FIG. 19 is a schematic process diagram illustrating a part of the conventional process of producing a coreless toilet paper roll; and FIG. 20 is a schematic side view of the conventional coreless toilet paper roll.

DETAILED DESCRIPTION OF THE PREFERRED EMBODIMENTS

Figure 1:
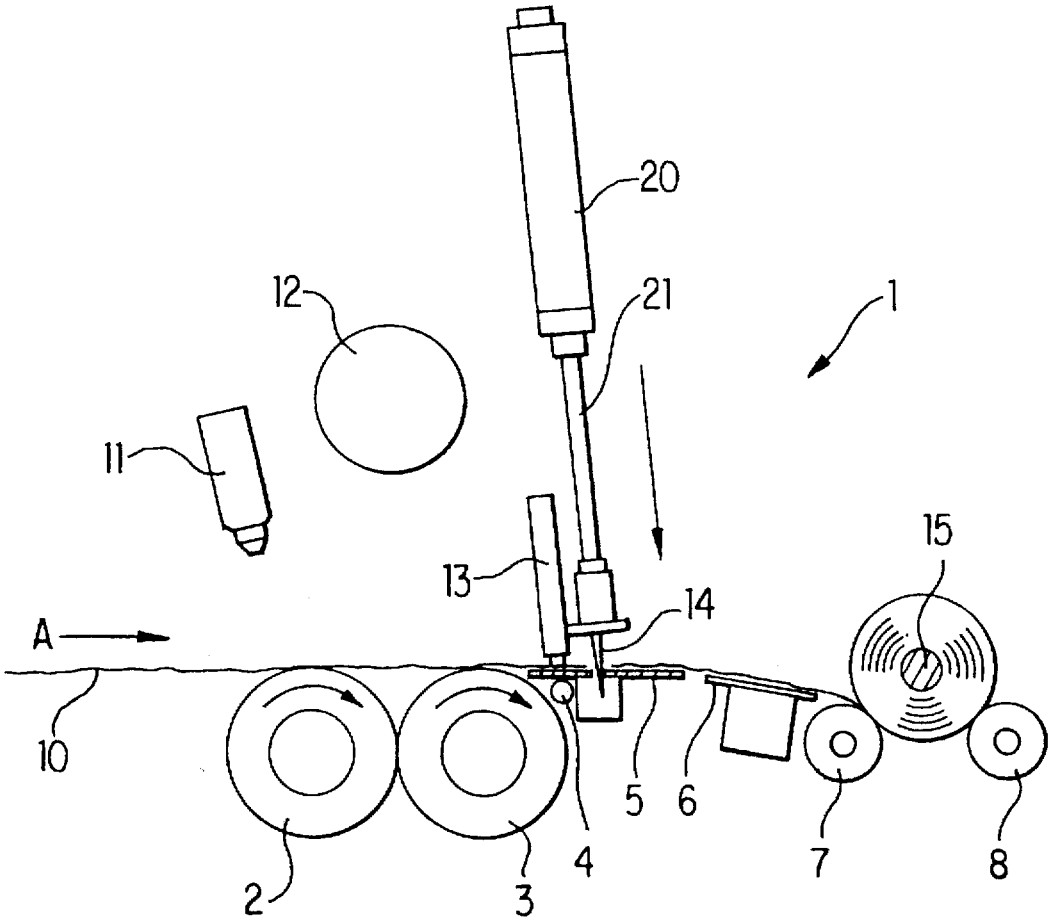
FIGS. 1 to 9 are diagrams for illustrating a method of producing a coreless toilet paper roll, which is an embodiment of the present invention.

Hereinafter, a method of producing a coreless toilet paper roll and the coreless toilet paper roll produced thereby, which is a preferred embodiment of the present invention, will be described in detail by referring to the accompanying drawings.

In FIGS. 1 to 9, reference numeral 1 designates a manufacturing apparatus for producing a coreless toilet paper roll. In a lower part of the coreless-toilet-paper-roll manufacturing apparatus 1, a first take-up roller 2, a second take-up roller 3, an air supplying portion 4, a first guide 5, a second guide 6, a first receiving roller 7 and a second receiving roller 8 are placed or arranged in sequence along a direction in which paper 10 is supplied from paper supplying means (not shown) (incidentally, such a direction is, for example, the direction A indicated in FIG. 1).

The first take-up roller 2 and the second take-up roller 3 are provided therein in such a manner as to be spaced apart from each other and as to face each other. Further, the first receiving roller 7 and the second receiving roller 8 are provided therein in such a way as to be spaced apart from each other and as to face each other. The first take-up roller 2 and the second take-up roller 3 are apart from each other by, for instance, about 3 mm.

Moreover, in an upper part of the coreless-toilet-paper-roll manufacturing apparatus 1, a spraying device 11

(incidentally, the spraying device is, for instance, a spray nozzle), a pressure roller 12 (namely, a nip roller), an adhesive supplying member 13 and a cutting portion 14 are placed or arranged in sequence along the direction in which the paper 10 is supplied from paper supplying means (incidentally, such a direction is, for example, the direction A indicated in FIG. 1, as above stated).

This spraying device 11 is operative to spray water onto the paper 10 for several seconds simultaneously with the winding of the paper 10 around a shaft 15 when performing the winding thereof. Namely, the spraying device 11 is used to facilitate the formation of the central portion of a coreless toilet paper roll.

Furthermore, the pressure roller 12 is provided in such a manner as to be able to ascend and descend by means of elevating means (not shown). Additionally, the pressure roller 12 is operative to abut against the paper 10 wound around the shaft 15 (to be described later) and to firmly wind the paper 10 around the shaft 15.

Further, the adhesive supplying member 13 and the cutting portion 14 are integrally mounted at an edge portion of a rod 21, which is adapted to move in such a way as to be able to advance and retreat, of a cylinder 20.

This adhesive supplying member 13 has an adhesive supplying portion 13*a* at an edge part thereof. This adhesive supplying portion 13*a* is attached to, for instance, an edge side of the rod 21 of the aforementioned cylinder 20, which moves in such a manner as to be able to advance and retreat, so that the adhesive supplying portion 13*a* does not face the shaft 15 but is adapted to move in such a way as to be able to approach and recede from the conveyed paper 10.

Moreover, the cutting portion 14 has, for example, a saw-blade-like cutting part (not shown) and is attached to, for example, the end portion of the rod 21, which moves in such a manner as to advance and retreat as above described, of the cylinder 20 so that the cutting portion 14 moves in such a way as to be able to approach and recede from the conveyed paper 10. When a predetermined amount of the paper 10 is wound around the shaft 15, a control portion (not shown) causes the rod 21 to stretch and approach the paper 10, which is being conveyed, as illustrated in FIG. 1. Thus, the paper 10 is cut.

Furthermore, during cutting the paper 10, the adhesive supplying portion 13*a* approaches a part of the paper 10, which is located close to the end portion thereof at the side of the second take-up roller 3. Then, an adhesive 13*b* is applied to the paper 10 from the adhesive supplying portion 13*a* in the direction of width thereof (for example, Fuyodine A-15 ("Fuyodine A-15" is a tradename for an adhesive manufactured by Fuyo Kasei Kabushiki Kaisha) is employed as the adhesive 13*b*). Incidentally, although the adhesive supplying member 13 and the cutting portion 14 are integrally mounted on the end portion of the rod 21, which is adapted to move in such a way as to be able to advance and retreat, of the cylinder 20, the adhesive supplying member 13 and the cutting portion 14 are not necessarily integral with each other. If the member 13 and the portion 14 are integral with each other similarly as in the case of this embodiment, both of a cutting operation and an adhesive-applying operation can be easily performed at the same time. Further, the manufacturing speed can be increased by performing both of the cutting operation and the adhesive-applying operation.

Figure 3:
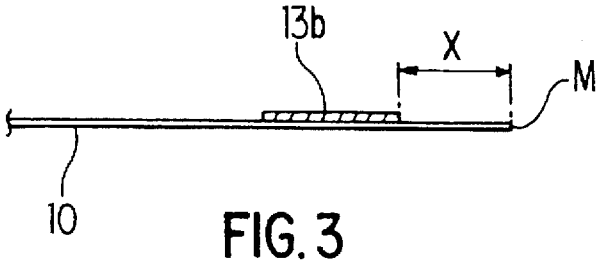
Figure 4:
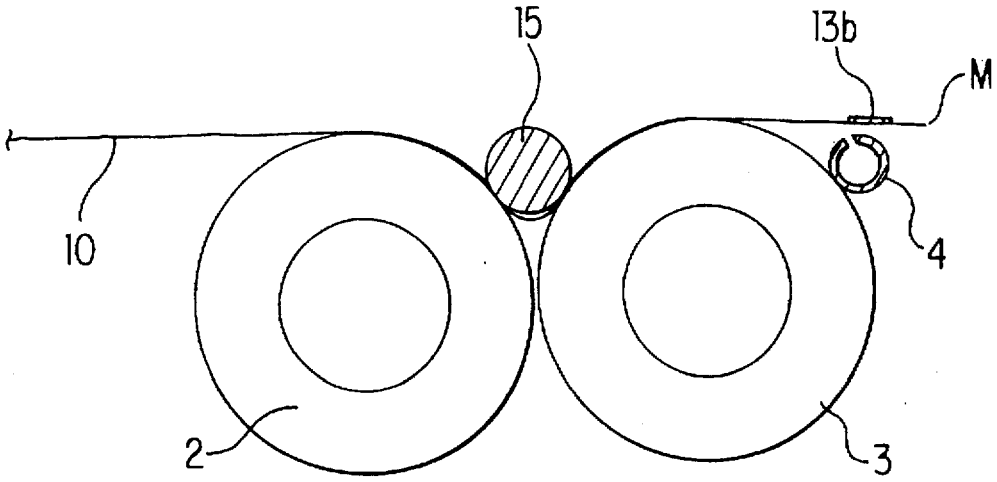

A part of the paper 10, onto which the adhesive 13*b* is applied, is located at a position which is closer to the end portion M thereof as illustrated in FIG. 3. More particularly, such a part of the paper 10 is located at a distance X from the end portion M of the paper 10 (incidentally, the distance X is about 1 to 4 cm or so).

Figure 2:
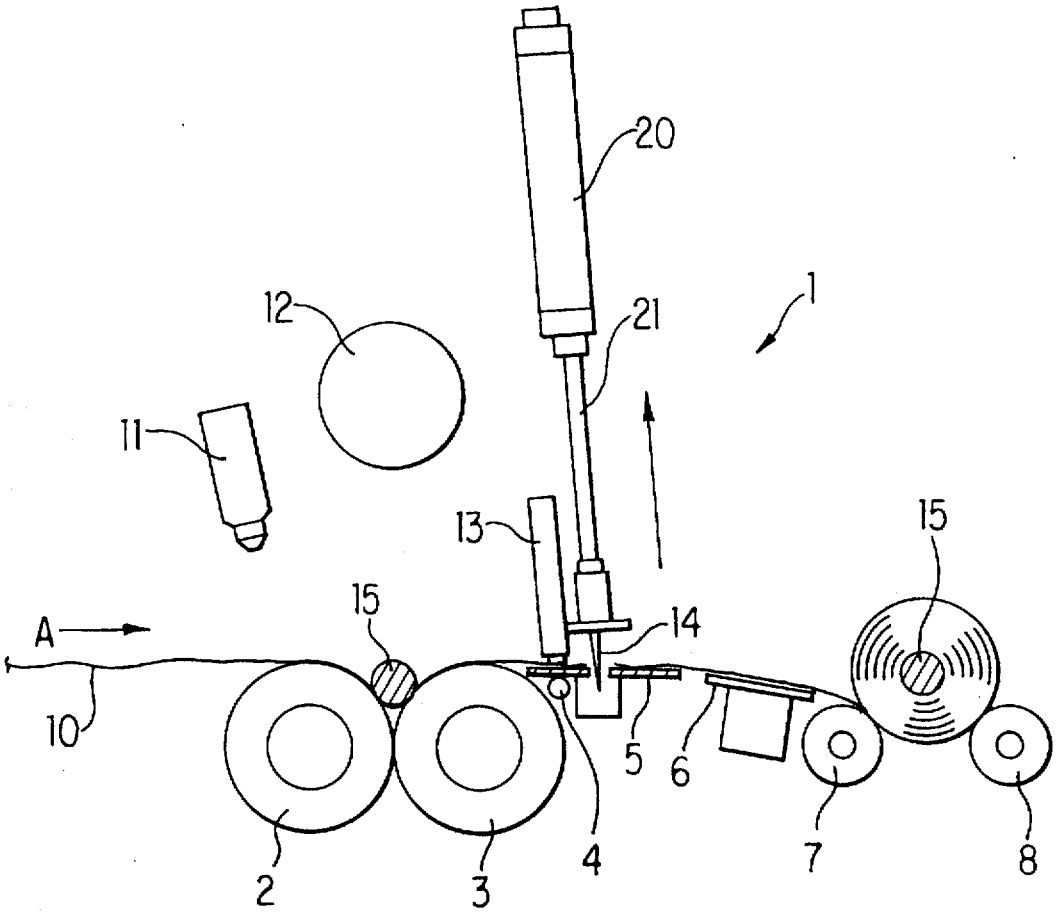

Further, as illustrated in FIG. 1, when cutting the paper 10, or after cutting the paper 10, the shaft 15 is fed onto the paper 10 by shaft feeding means (not shown) as shown in FIG. 2, so that the shaft 15 is positioned on the paper 10.

After the adhesive 13*b* is applied onto the paper 10 by, for instance, being sprayed thereto, the paper 10 is folded back in such a manner as to be laid across the shaft 15, by being supplied with air from the air supplying portion 4 provided on the back-surface-side of the paper 10. Further, the part of the paper 10, to which the adhesive is applied, is brought into abutting engagement with another part thereof, so that these parts of the paper 10 are glued together (see FIG. 5).

Thus, when applying the adhesive 13*b*, the adhesive 13*b* can be applied to the paper 10 in the direction of width thereof from the adhesive supplying portion 13*a* by bringing the adhesive supplying potion 13*a* near to a part of the paper 10, which is close to the end portion of the paper 10 on the side of the second roller 3, without causing the adhesive supplying portion 13*a* and the shaft 15 to face each other. Moreover, the adhesive 13*b* is prevented from being stuck to the shaft 15. Thereby, the adhesive 13*b* can be applied to a part of the paper 10, which is located at a position closer to the end portion M thereof (for example, to a part of the paper at a distance of about 1 to 4 cm from the end portion M of the paper 10). Consequently, when produced as a commercially available product, the initial end portion of a coreless toilet paper roll is prevented from fraying.

Figure 5:
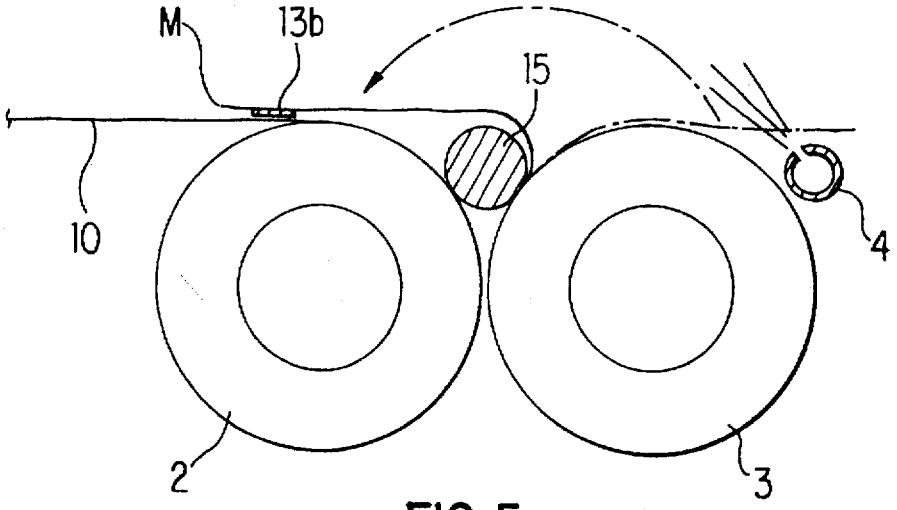
Figure 6:
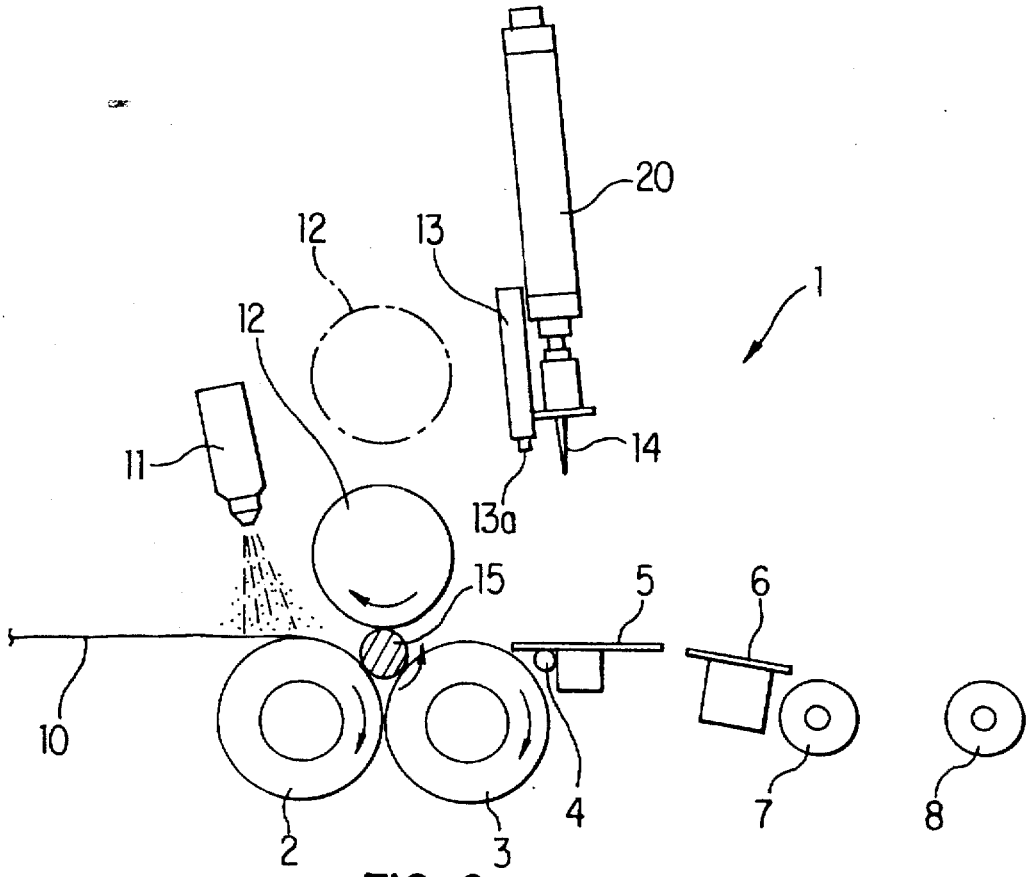
Figure 7:
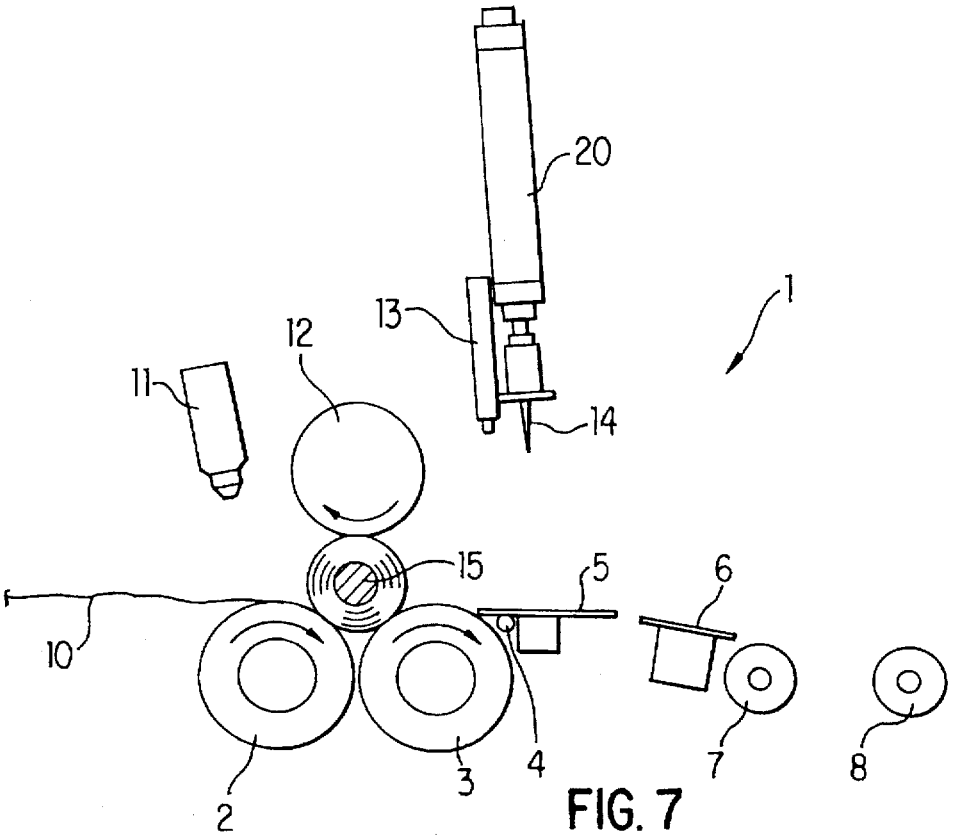
Figure 8:
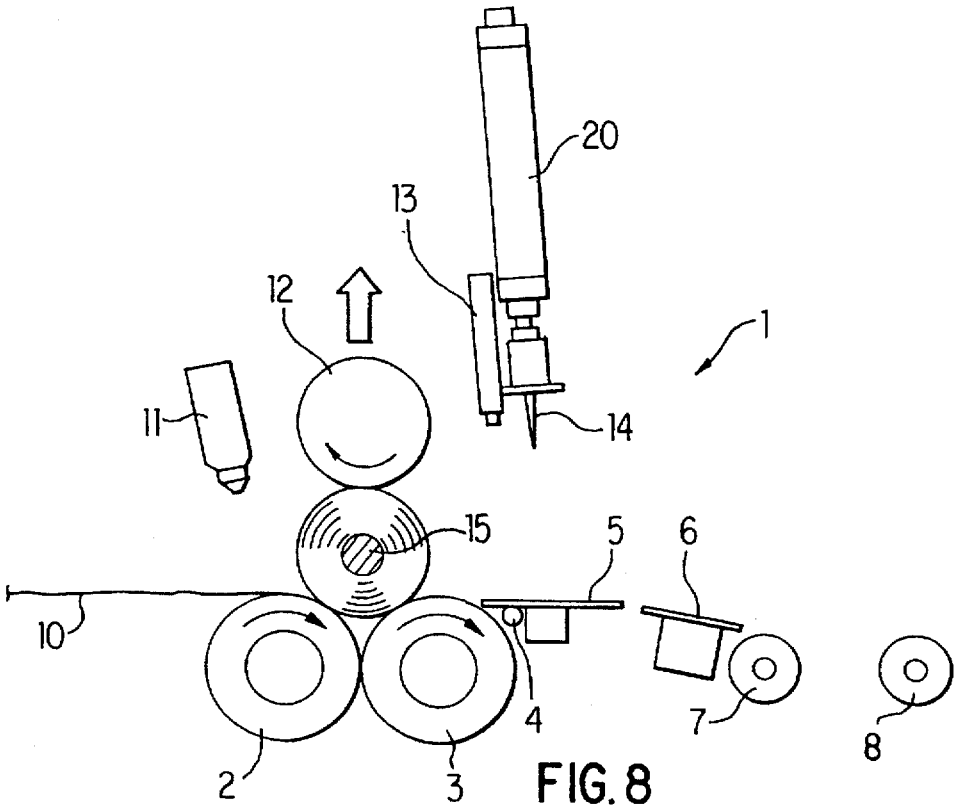

Incidentally, as illustrated in FIG. 5, after the paper 10 is folded back in such a way as to be laid across the shaft 15, the first take-up roller 2 and the second take-up roller 3 are rotated clockwise and the shaft 15 is rotated counterclockwise (see FIG. 6). Further, the pressure roller 12 is caused to descend while winding the paper 10 around the shaft 15. Thus, the pressure roller 12 is brought into abutting engagement with the wound paper 10, so that the paper 10 is firmly wound around the shaft 15 (see FIG. 7). Furthermore, when winding the paper 10 around the shaft 15, mist-like water is sprayed onto the paper 10 from the spraying device 11 for several seconds, simultaneously with the winding of the paper 10 around the shaft 15. Additionally, as the paper 10 is gradually wound around the shaft 15, the diameter of the wound paper (roll) 10 becomes larger. This is followed by the ascent of the pressure roller 12 (see FIG. 8).

Further, when a predetermined amount of the paper 10 is wound around the shaft 15, the shaft 15 is transferred to a position indicated in FIG. 1 by transfer means (not shown). Thus, the paper 10 with the predetermined amount wound around the shaft 15 is received by the first receiving roller 7 and the second receiving roller 8. Thereafter, the paper 10 is cut by the cutting portion 14 as illustrated in FIG. 1.

Figure 9:
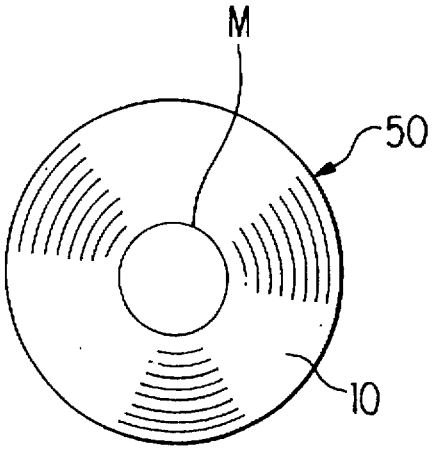

After cutting the paper 10, the shaft 15 is detached from the wound paper 10. Moreover, the wound paper 10 (incidentally, the diameter of the coreless portion (namely, the hole) thereof is about 2.0 to 3.8 cm and the wound paper 10 has a diameter of about 11.5 cm and further has a width of about 150 to 250 cm) is cut into paper rollers, each of which has a predetermined width of, for instance, about 11.5 cm. Thus, a coreless toilet paper roll 50 as illustrated in FIG. 9 is produced.

Incidentally, in the case of the aforementioned embodiment, the adhesive 13*b* is applied from the adhesive supplying portion 13 to the paper 10 in the direction of width thereof by bringing the adhesive supplying portion 13 close to the end portion M of the paper 10 on the side of the second take-up roller 3. However, an adhesive supplying member 13' may be provided at a suitable position between the pressure roller 12 and the spraying device 11 in such a way as to be able to ascend and descend, instead of the adhesive supplying portion 13 of FIGS. 1 to 8.

Figure 10:
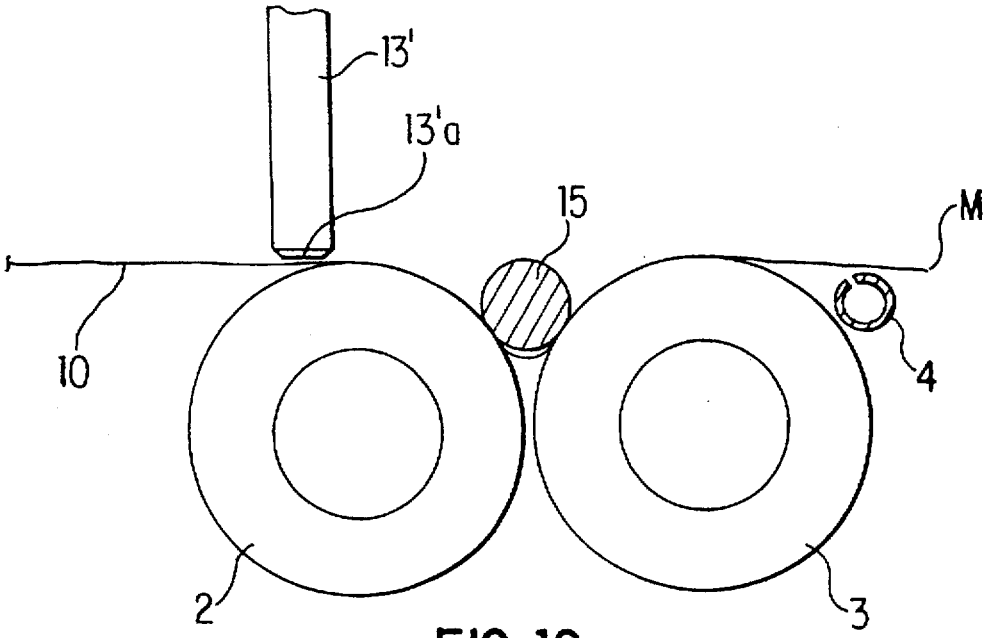
FIGS. 10 and 11 illustrate another embodiment to be contrasted with the embodiment illustrated in FIGS. 4 and 5.
Figure 11:
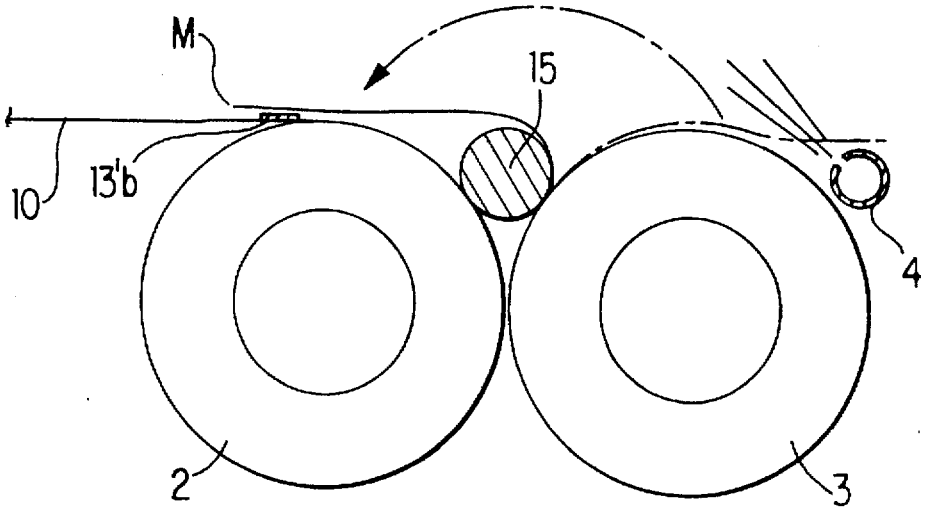

Namely, as illustrated in FIGS. 10 and 11, an adhesive **13'*b* may be applied to the paper 10 in the direction of width thereof by bringing an adhesive supplying portion 13'*a*, which is provided at the edge of the adhesive supplying member 13', close to a part of the paper 10, which is located upstream from the shaft 15, without causing the adhesive supplying portion 13'*a* and the shaft 15 to face each other. Moreover, such a part of the paper 10 may be brought into abutting engagement with another part, to which no adhesive is applied, of the paper 10 and these parts of the paper 10 may be glued together by supplying air from the air supplying portion 4 provided at the side of the end portion M of the paper 10 under the back surface thereof and subsequently folding back the paper in such a way as to be laid over the shaft 15 (see FIG. 11**).

Figure 12:
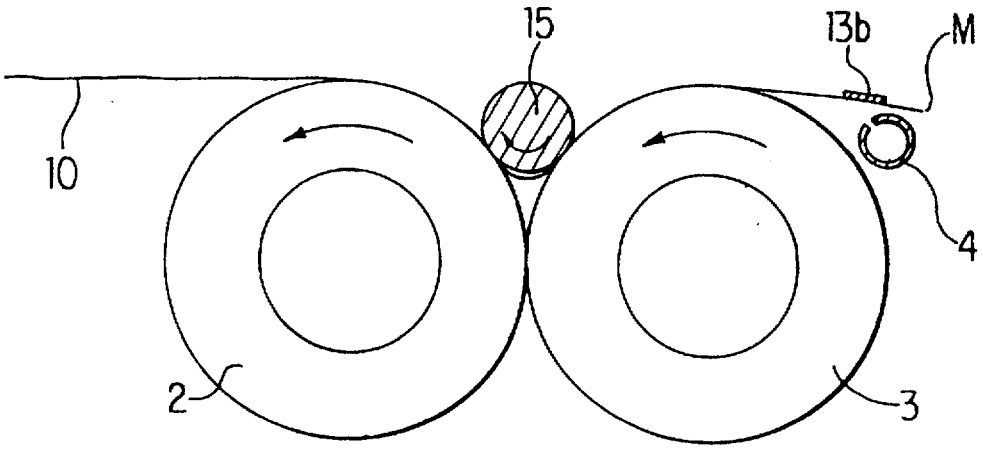
FIGS. 12 to 14 illustrate still another embodiment to be contrasted with the embodiment illustrated in FIGS. 4 and 5.
Figure 13:
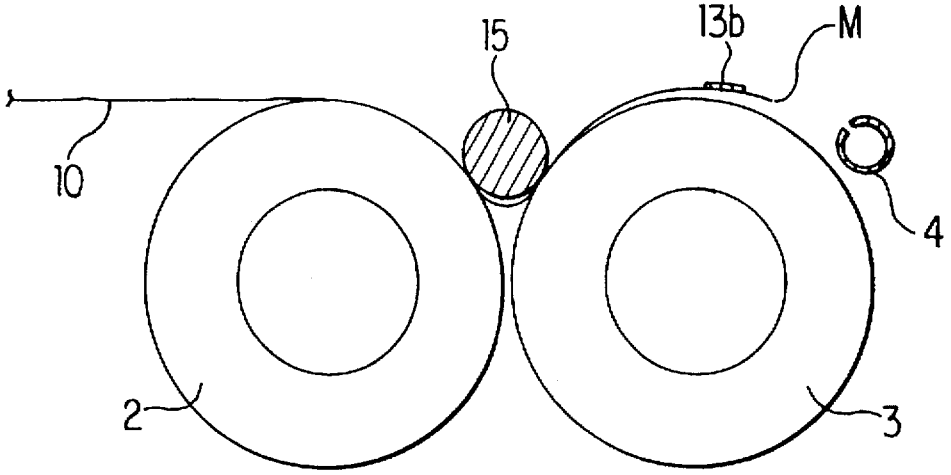
Figure 14:
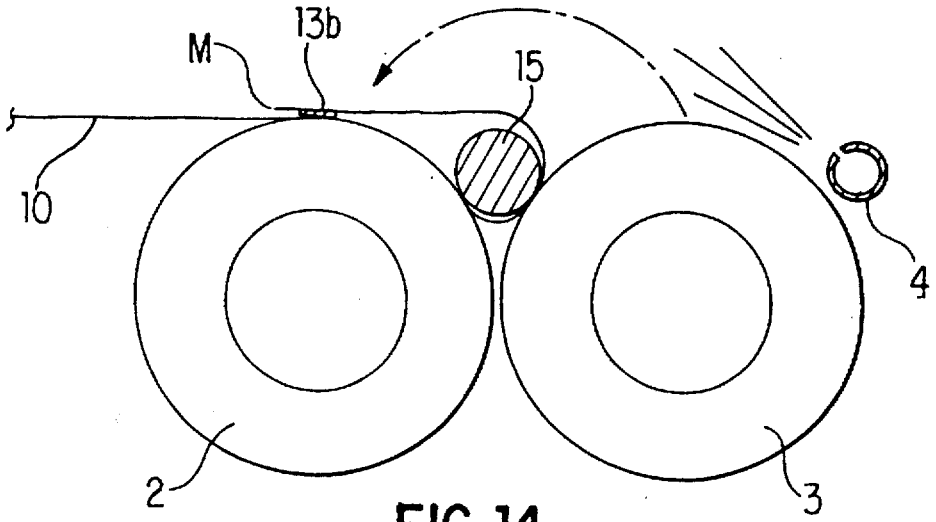

Furthermore, in the case of the aforementioned embodiment, the paper 10 is folded back at a position, at which the paper 10 is cut, after the adhesive **13*b* or 13'*b* is applied to the paper 10. However, there occurs a looseness in the initial portion of the paper 10 with respect to the shaft 15. Thus, as illustrated in FIGS. 12 to 14 (which show modifications respectively corresponding to the embodiments of FIGS. 4 and 5), such modification may be employed as follows. Namely, the first take-up roller-2 and the second take-up roller 3 are rotated counterclockwise after the adhesive 13*b* is applied to the paper 10. Thereafter, a part of the paper 10, on which the adhesive 13*b* is applied, is brought into abutting engagement with another part thereof, to which no adhesive is applied, and these parts of the paper 10 are then glued together by being folded back in such a manner as to be laid over the shaft 15 while air is supplied from the air supplying portion 4 provided under the back surface of the part of the paper 10, to which the adhesive 13*b*** is applied.

Figure 15:
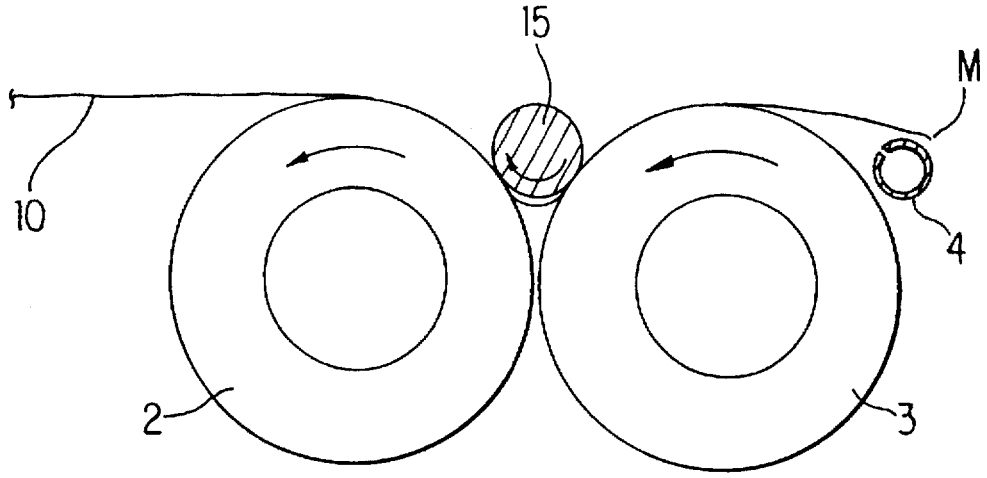
FIGS. 15 to 17 illustrate yet another embodiment to be contrasted with the embodiment illustrated in FIGS. 4 and 5.
Figure 16:
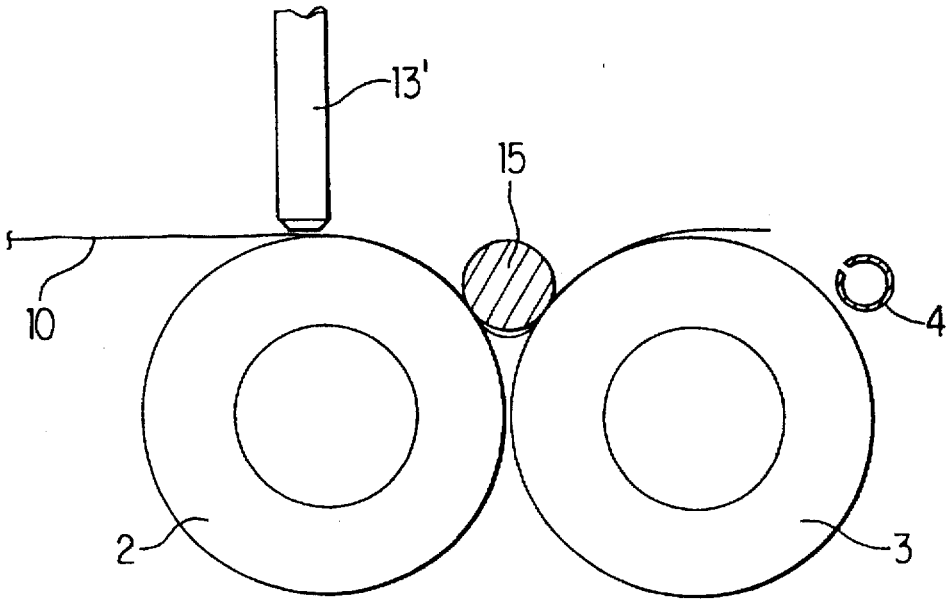
Figure 17:
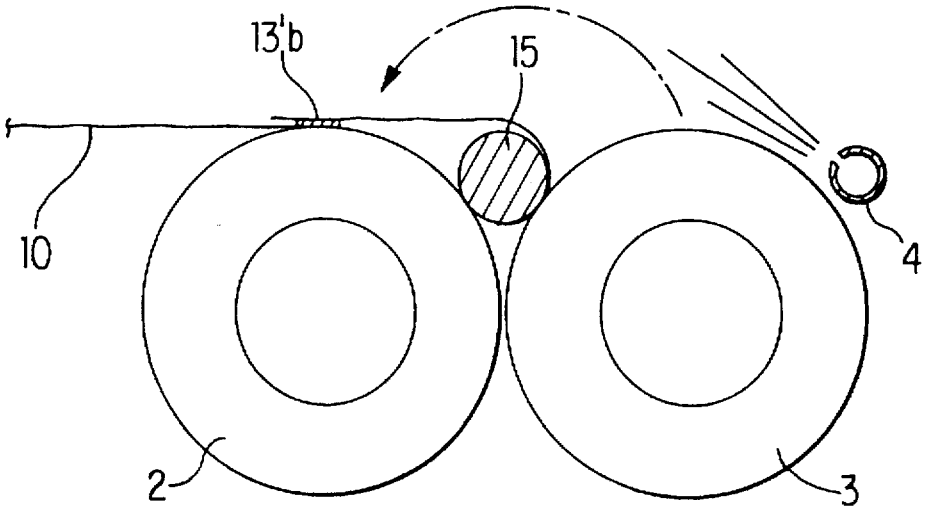
Figure 18:
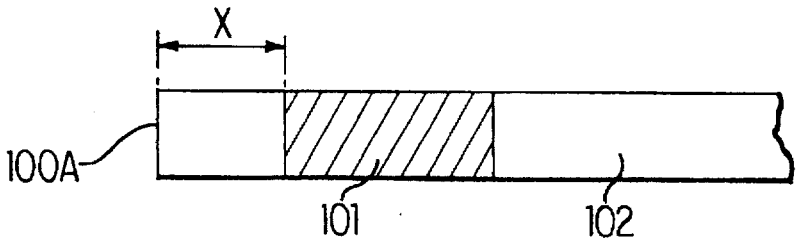
FIG. 18 PRIOR ART
FIGS. 18 to 20 illustrate the prior art.
Figure 19:
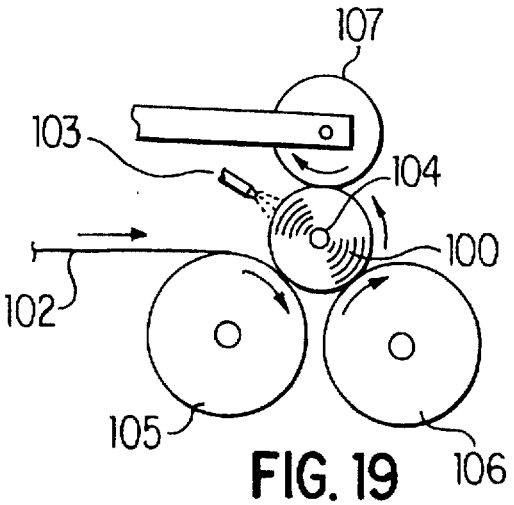
FIG. 19 PRIOR ART
Figure 20:
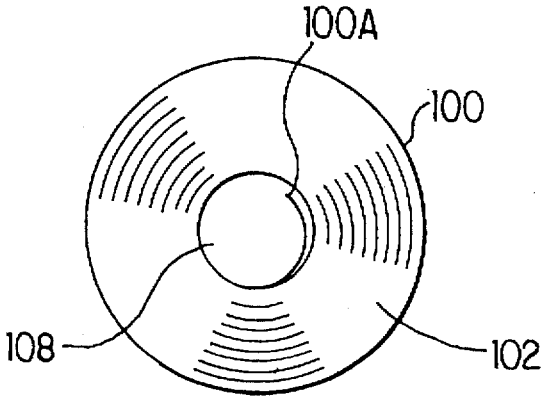
FIG. 20 PRIOR ART

Further, the following modification may be employed. Namely, as illustrated in FIG. 15, the first take-up roller 2 and the second take-up roller 3 are rotated counterclockwise before the adhesive **13'*b* is applied to the paper 10. Thereafter, the adhesive 13'*b* is applied thereto (see FIG. 16). Subsequently, as illustrated in FIG. 17, air is supplied from the air supplying portion 4 provided under the back surface of a part, to which the adhesive is applied, of the paper 10. Thus, such a part of the paper 10 is folded back in such a way as to be laid over the shaft 15 and to be brought into abutting engagement with another part thereof, to which no adhesive is applied. Then, these parts of the paper 10 are glued together (incidentally, FIGS. 15 to 17 show further modifications respectively corresponding to those of FIGS. 10 and 11**).

Thus, the paper 10 can be wound around the shaft 15 by reducing the looseness in the initial portion of the paper 10 with respect to the shaft 15. Moreover, an occurrence of a fray can be prevented by locating the end portion M of the initial portion of the toilet paper roll 50 at an inner position.

Although the preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

What is claimed is:

1. A method of producing a coreless toilet paper roll, comprising the steps of:

placing a first take-up roller and a second take-up roller in sequence along a paper supplying direction in which paper is supplied from paper supplying means, the first take-up roller and the second take-up roller being provided in such a way as to be spaced apart from each other and as to face each other;

placing a pressure roller, an adhesive supplying member and a cutting portion in sequence above the first take-up roller and the second take-up roller along the paper supplying direction, the pressure roller being operative to abut against paper wound around a shaft to thereby wind the paper around the shaft firmly, the adhesive supplying member having an adhesive supplying portion provided so that the adhesive supplying portion does not face the shaft and that the adhesive supplying portion is able to move in such a manner as to approach and recede from paper which is being conveyed thereto, the cutting portion being provided so that the cutting portion is able to move in such a manner as to approach and recede from paper which is being conveyed thereto and so that when a predetermined amount of paper is wound around the shaft, the cutting portion approaches the paper conveyed thereto and cuts the paper;

placing paper, which is supplied from the paper supplying means, on the first take-up roller and the second take-up roller, and positioning the shaft on the supplied paper;

bringing the adhesive supplying portion close to a part of paper, which is located near an end portion thereof on a side of the second take-up roller, without causing the adhesive supplying portion and the shaft to face each other, and applying an adhesive onto the paper in a direction of width thereof from the adhesive supplying portion;

supplying air from a side of a back surface of a part, to which the adhesive is applied, of the paper, and folding back the paper in such a way as to be laid over the shaft, thereby bringing the part, to which the adhesive is applied, of the paper into abutting engagement with a part, to which no adhesive is applied, of the paper and thereby gluing the parts of the paper together;

thereafter rotating the first take-up roller and the second take-up roller clockwise and rotating the shaft counterclockwise, and winding the paper around the shaft and bringing the pressure roller into abutting engagement with the paper wound therearound, thereby firmly winding the paper around the shaft; and thereafter detaching the shaft from the wound paper, thereby producing a toilet paper roll.

2. The method of producing a coreless toilet paper roll, according to claim 1, wherein an operation of applying the adhesive onto the part of the paper, which is located near the end portion of the paper on the side of the second take-up roller and which is used to wind up a current coreless toilet paper roll, in the direction of width thereof is performed simultaneously with an operation of cutting the paper by means of the cutting portion to be performed upon completion of an operation of winding up a coreless toilet paper roll which is precedent to the current coreless toilet paper roll.

3. A method of producing a coreless toilet paper roll, comprising the steps of:

placing a first take-up roller and a second take-up roller in sequence along a paper supplying direction in which paper is supplied from paper supplying means, the first take-up roller and the second take-up roller being provided in such a way as to be spaced apart from each other and as to face each other;

placing a pressure roller, an adhesive supplying member and a cutting portion in sequence above the first take-up roller and the second take-up roller along the paper supplying direction, the pressure roller being operative to abut against paper wound around a shaft to thereby wind the paper around the shaft firmly, the adhesive supplying member having an adhesive supplying portion provided so that the adhesive supplying portion does not face the shaft and that the adhesive supplying portion is able to move in such a manner as to approach and recede from paper which is being conveyed thereto, the cutting portion being provided so that the cutting portion is able to move in such a manner as to approach and recede from paper which is being conveyed thereto and so that when a predetermined amount of paper is wound around the shaft, the cutting portion approaches the paper conveyed thereto and cuts the paper;

placing paper, which is supplied from the paper supplying means, on the first take-up roller and the second take-up roller, and positioning the shaft on the supplied paper;

bringing the adhesive supplying portion close to a part of paper, which is located near an end portion thereof on a side of the second take-up roller, without causing the adhesive supplying portion and the shaft to face each other, and applying an adhesive onto the paper in a direction of width thereof from the adhesive supplying portion;

rotating the first take-up roller and the second take-up roller counterclockwise and bringing the end portion of the paper close to the shaft;

thereafter supplying air from a side of a back surface of a part, to which the adhesive is applied, of the paper, and folding back the paper in such a way as to be laid over the shaft, thereby bringing the part, to which the adhesive is applied, of the paper into abutting engagement with a part, to which no adhesive is applied, of the paper and thereby gluing the parts of the paper together;

thereafter rotating the first take-up roller and the second take-up roller clockwise and rotating the shaft counterclockwise, and winding the paper around the shaft and bringing the pressure roller into abutting engagement with the paper wound therearound, thereby firmly winding the paper around the shaft; and thereafter detaching the shaft from the wound paper, thereby producing a toilet paper roll.

4. A method of producing a coreless toilet paper roll, comprising the steps of:

placing a first take-up roller and a second take-up roller in sequence along a paper supplying direction in which paper is supplied from paper supplying means, the first take-up roller and the second take-up roller being provided in such a way as to be spaced apart from each other and as to face each other;

placing a pressure roller, an adhesive supplying member and a cutting portion in sequence above the first take-up roller and the second take-up roller along the paper supplying direction, the pressure roller being operative to abut against paper wound around a shaft to thereby wind the paper around the shaft firmly, the adhesive supplying member having an adhesive supplying portion provided so that the adhesive supplying portion does not face the shaft and that the adhesive supplying portion is able to move in such a manner as to approach and recede from paper which is being conveyed thereto, the cutting portion being provided so that the cutting portion is able to move in such a manner as to approach and recede from paper which is being conveyed thereto and so that when a predetermined amount of paper is wound around the shaft, the cutting portion approaches the paper conveyed thereto and cuts the paper;

placing paper, which is supplied from the paper supplying means, on the first take-up roller and the second take-up roller, and positioning the shaft on the supplied paper;

bringing the adhesive supplying portion close to a part of paper, which is located near an end portion thereof relative to the shaft, without causing the adhesive supplying portion and the shaft to face each other, and applying an adhesive onto the paper in a direction of width thereof from the adhesive supplying portion, and supplying air from a side of a back surface of a part, to which the adhesive is applied, of the paper, and folding back the paper in such a way as to be laid over the shaft, thereby bringing the part, to which the adhesive is applied, of the paper into abutting engagement with a part, to which no adhesive is applied, of the paper and thereby gluing the parts of the paper together;

thereafter rotating the first take-up roller and the second take-up roller clockwise and rotating the shaft counterclockwise, and winding the paper around the shaft and bringing the pressure roller into abutting engagement with the paper wound therearound, thereby firmly winding the paper around the shaft; and thereafter detaching the shaft from the wound paper, thereby producing a toilet paper roll.

5. A coreless toilet paper roll comprising:

a paper roll body, in a central portion of which a hole is formed; and a roll-like portion provided at an initial end of the paper roll body, wherein the roll-like portion is formed like a roll by folding back an initial end portion of paper in such a manner as to be laid over a shaft, around which the paper is wound, and by gluing an initial end part and an inner part, which is located at a distance of about 1 to 4 cm from the initial end part, of the initial end portion of the paper together, with an adhesive, and wherein the paper roll body is formed by winding up a remaining portion of the paper around the shaft, and the hole is formed by detaching the shaft from the paper roll body.

* * * * *